United States Patent [19]

Tanaka et al.

[11] 3,964,827

[45] June 22, 1976

[54] ION MODULATED IMAGE FORMING APPARATUS

[75] Inventors: Hidetoshi Tanaka, Musashino; Toshiro Kasamura, Kawasaki; Tadashi Sato, Kokubunji, all of Japan

[73] Assignee: Canon Kabushiki Kaisha, Tokyo, Japan

[22] Filed: Nov. 19, 1974

[21] Appl. No.: 525,196

[30] Foreign Application Priority Data

Nov. 29, 1973 Japan ..... 48-134619

[52] U.S. Cl. ..... 355/3 R

[51] Int. Cl.[2] ..... G03G 15/044

[58] Field of Search ..... 355/3 R, 3 SC, 3 CH, 355/8, 16, 17; 96/1 R

[56] References Cited

UNITED STATES PATENTS

| | | | |
|---|---|---|---|
| 3,582,206 | 6/1971 | Burdige | 355/16 |
| 3,645,614 | 2/1972 | McFarlane et al. | 355/3 R |
| 3,687,539 | 8/1972 | Furuichi | 355/8 |
| 3,754,822 | 8/1973 | Melrose | 355/8 |
| 3,797,926 | 3/1974 | Fotland et al. | 355/35 C |

*Primary Examiner*—L. T. Hix
*Assistant Examiner*—James LaBarge
*Attorney, Agent, or Firm*—Fitzpatrick, Cella, Harper & Scinto

[57] ABSTRACT

In an image forming apparatus wherein a primary electrostatic latent image is formed on a photosensitive screen having a multitude of tiny openings therein and then an ion flow is modulated by the primary electrostatic latent image to thereby form a secondary electrostatic latent image on a chargeable member, the secondary electrostatic latent image formation occurs with both the screen bearing the primary electrostatic latent image thereon and the chargeable member being moved in the same direction and at the same velocity but with a corona discharge device for forming the secondary electrostatic latent image on the chargeable member being moved in the direction opposite to the direction of movement of the screen and chargeable member.

18 Claims, 14 Drawing Figures

ION MODULATED IMAGE FORMING APPARATUS

BACKGROUND OF THE INVENTION

1. Field of the Invention

This invention relates to an image forming apparatus which uses a screen-like photosensitive medium having a multitude of tiny openings therein (hereinafter referred to as "photosensitive screen"). More particularly, it relates to an image forming apparatus which uses a photosensitive screen to enable copy images to be produced at a high speed.

2. Description of the Prior Art

Electrophotographic methods using photosensitive screens are disclosed in Japanese Patent Publication No. 21142/1972, U.S. Pat. No. 3,680,954, etc. The electrophotographic method described in said Japanese Patent Publication involves the steps of uniformly charging the surface of a photosensitive screen having a multitude of openings therein and comprising an electrically conductive back-up member and a photoconductive layer, then projecting an original image upon the photosensitive screen, and forming on the screen an electrostatic latent image corresponding to the original image (hereinafter referred to as "primary electrostatic latent image"). Thereafter, a recording member having a chargeable layer is disposed and held in a predetermined spaced-apart and opposed relationship with the screen surface bearing the primary electrostatic latent image. Corona discharge is then applied to the surface of the recording member through the photosensitive screen, whereby an ion flow is modulated by the electric field of the primary electrostatic latent image to form on the recording member an electrostatic latent image corresponding to the original image (hereinafter referred to as "secondary electrostatic latent image"). The secondary electrostatic latent image formed in the described manner is thereafter developed into a visible image by a developing technique commonly used in the known electrophotographic method. The method disclosed in U.S. Pat. No. 3,680,954 differs in construction of the photosensitive screen, but it may be said to be a similar art that such screen is used for the image formation.

With conventional apparatus of the type wherein a secondary electrostatic latent image is formed repetitively from a common primary electrostatic latent image, formation of the secondary electrostatic latent image has been done either by stopping a planar photosensitive screen, opposed to which a recording member is temporarily stopped with a flat surface of a predetermined length, while moving a corona discharger or by moving the photosensitive screen and the recording member in the same direction and at the same velocity while using a stationary corona discharger. The former system has required some time for interchange of the recording member, and the latter system has also required the recording member not to be fed until the screen is restored to its initial position. The planar photosensitive screen is thus easy and simple to make, whereas an apparatus using such a planar photosensitive screen has encountered problems in forming secondary electrostatic latent images at a high speed.

SUMMARY OF THE INVENTION

It is an object of the present invention utilizing a photosensitive screen as described above, to form a secondary electrostatic latent image at a higher speed than that attainable with conventional apparatus using such screen.

It is another object of the present invention to provide an image forming apparatus which can form a secondary electrostatic latent image repetitively from a common primary electrostatic latent image on the photosensitive screen and in which a member for forming the secondary electrostatic latent image may be efficiently moved to enable the secondary electrostatic latent image to be formed at a high speed.

Other objects and features of the present invention will appear as the following detailed description of the invention proceeds.

In the apparatus which achieves the above objects of the present invention, i.e. the image forming apparatus wherein a primary electrostatic latent image is formed on a photosensitive screen having a multitude of tiny openings therein, whereafter an ion flow is modulated by the primary electrostatic latent image to thereby form a secondary electrostatic latent image on a chargeable member, the improvement resides in that, during the formation of the secondary electrostatic latent image, the screen bearing the primary electrostatic latent image thereon and the chargeable member are moved in the same direction and at the same velocity while the means for producing ions for forming the secondary electrostatic latent image on the chargeable member is moved in the direction opposite to the direction of movement of the screen and chargeable member, thereby forming the secondary electrostatic latent image. The source for generating the ion flow may generally be a corona discharger.

DESCRIPTION OF THE PREFERRED EMBODIMENTS

Some embodiments of the present invention will hereinafter be described by reference to the drawings. Before the apparatus embodying the present invention is described, a photosensitive screen will first be described which is used in the apparatus illustratively shown herein.

Figure 1:
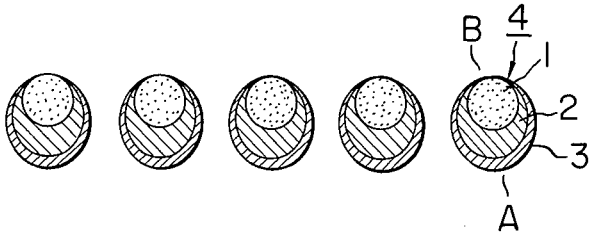
FIG. 1 is an enlarged sectional view of a photosensitive screen used in the apparatus embodying the present invention.

FIG. 1 shows such photosensitive screen in enlarged cross-sectional view, and FIGS. 2 to 5 schematically illustrate the steps of process whereby an electrostatic latent image is formed by the use of the screen shown in FIG. 1. First, as shown in FIG. 1, the screen 4 comprises an electrically conductive member 1 having a multitude of tiny openings therein, a photoconductive member 2 and an insulating member 3, the members 2 and 3 being successively layered over the member 1 in such a manner that a portion of the member 1 is exposed.

The electrically conductive member 1 may be formed by etching a plate of metal such as stainless steel or nickel to form tiny openings therein or by knitting, electroplating, or forming metal wire into netting. The mesh value of the conductive member 1, 100 to 400 meshes would be suitable in terms of resolving power for copying. The photoconductive member 2 may be formed by evaporating Se-alloy or the like, or by spraying a dispersed phase of insulative resin containing particles of CdS, PbO or the like. The insulating member 3 may be formed by spraying or vacuumevaporating an inorganic insulator material of solvent type such as epoxy-resin, acrylic resin or silicone resin. In the selection of the materials for the screen and the formation thereof, use may be made of the technique for planar photosensitive medium in the conventional art of electrophotography. In order to form the members 2 and 3 so as to leave the conductive member 1 partly exposed, the portions of the members 2 and 3 which have covered or spread over the conductive member 1 on one side thereof may be ground off.

Figure 2:
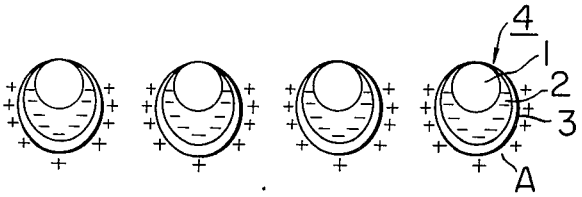
FIGS. 2 to 4 illustrate the process of forming a primary electrostatic latent image by the use of the photosensitive screen shown in FIG. 1.

FIGS. 2 to 5 are illustrations of the steps involved in the formation of an electrostatic latent image by the use of the above-described screen 4. FIG. 2 shows the step of primary voltage application, wherein a semiconductor consisting of CdS and a resin binder and using electrons as the main carrier is employed as the substance forming the photoconductive member. Therefore, the first charging is effected by charging means such as a corona discharger so that the insulating member 3 is uniformly charged with positive polarity. By such charging, electrons are introduced into the photoconductive member 2 through the conductive member 1 and captured in the interface between the photoconductive member 2 and the insulating member 3. The above-described charging is effected from that side on which the conductive member 1 is not exposed (hereinafter referred to as "surface A side"), but the surface A side could hardly be charged if corona discharge is applied from that side on which the conductive member 1 is exposed (hereinafter referred to as "surface B side"). The surface potential becomes saturated at a voltage much lower than the dielectric breakdown voltage of the insulating member. This is believed to be attributable to the fact that, when the insulating member becomes charged to a certain potential, the field directed from the insulating member toward the exposed portion of the conductive member becomes stronger with a result that corona ions do not stick to the insulating member but flow toward the exposed conductive portion. This phenomenon substantially prevents the photosensitive screen 4 from suffering from the dielectric breakdown due to excess charge.

Figure 3:
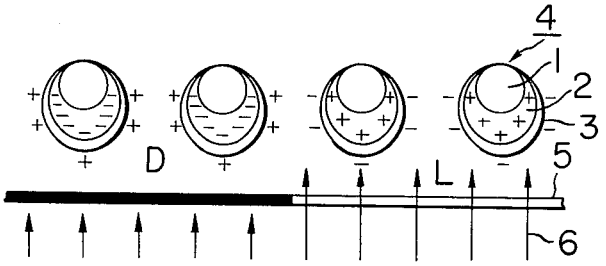

FIG. 3 illustrates the result obtained by effecting the step of secondary voltage application on the screen 4 already subjected to the above-described primary charging, which step comprises applying image-carrying light rays or radiant rays reacting in accordance with the property of the substance forming the photoconductive member and simultaneously therewith or thereafter, applying a secondary voltage from a corona discharger of negative polarity so that the surface potential of the insulating member is substantially of the negative polarity. In the formation of an electrostatic latent image on a common multi-layered photo-sensitive medium which is not in the form of a screen, it is difficult to control the potential to a level near zero by using a DC corona discharger and so, use must be made of an AC corona discharger or a DC corona discharger provided with a grid. However, where use is made of a photosensitive screen such as the screen 4 which has exposed conductive portions, the saturation of potential occurs at a low voltage due to the phenomenon described above in connection with the primary charging and therefore, DC corona discharge can be used and may be even better suited with the charging rate taken into account. If the surface potential of the insulating member 3 is rendered negative, the charge on the surface of the insulating member 3 in the light region thereof which is exposed to the image-carrying rays will become negative. In the dark region, however, the charge on the surface of the insulating member may remain positive due to the negative charge present in the interface between the insulating member 3 and the photoconductive member 2. The deelectrification need not coincide perfectly with the exposure. In FIG. 3, the image application is shown to be of the transmission type and numeral 5 designates an original to be copied, 6 denotes light rays, and L and D refer to light and dark regions, respectively. The image application and subsequent overall irradiation can be effected from the surface B side, as well.

Figure 4:
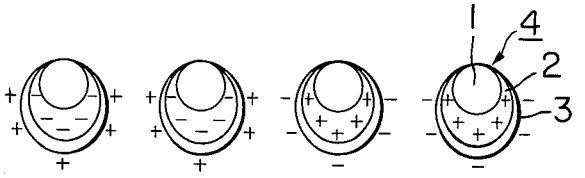

FIG. 4 shows the result obtained by effecting uniform overall irradiation on the entire surface of the photosensitive screen 4 which has already been subjected to the application of image light and secondary voltage, as described above. This overall irradiation causes the potential across the dark region of the screen 4 to be varied to a potential proportional to the quantity of surface charge on the insulating member 3. In other words, the overall irradiation causes the photoconductive member 2 in the dark region to sharply reduce its resistance value so as to become conductive. As a result, the negative charge captured therewithin is discharged in accordance with the quantity of surface charge. In contrast, the photoconductive member in the light region does not exhibit as much variation so that a great potential difference is provided between the light and dark regions of the surface of the photosensitive screen 4. Since the thickness of the photoconductive member 3 is continuously decreased from the surface A toward the opposite lateral sides, the surface B in the dark region assumes zero potential as the potential of the latent image is decreased, and the potential will gradually be varied to a higher positive potential from said lateral sides toward the surface A.

Figure 5:
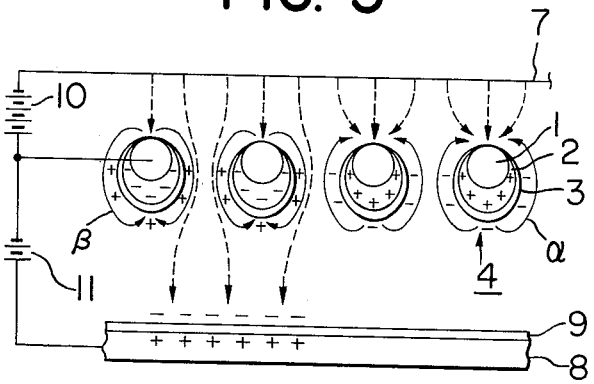
FIG. 5 illustrates the process of forming a secondary electrostatic latent image by the use of a screen bearing the primary electrostatic latent image thereon.

FIG. 5 shows a manner in which the ion flow is modulated by the primary electrostatic latent image on the screen 4 to cause a positive image corresponding to the original image to be formed by the charge. In FIG. 5, numeral 7 designates a corona wire which is the means for forming a secondary electrostatic latent image, numeral 8 designates an electrode member, numeral 9 designates a recording member capable of retaining charges thereon, and numerals 10 and 11 denote voltage sources. The recording member 9 is disposed adjacent to that side of the screen 4 on which the insulating member 3 exists, while the wire 7 is disposed adjacent to that side of the screen 4 on which the exposed conductive member 1 exists, so that the ion flow from the wire 7 is applied to the recording member 9 by the utilization of the potential difference between the wire 7 and the electrode 8. At this time, in the light region of the screen, an electric field as indicated by solid line $\alpha$ is developed by the charges forming the primary electrostatic latent image. Thereby, the ion flow indicated by dashed lines is prevented from passing through the screen and is directed into the exposed conductive member 1. On the other hand, in the dark region of the screen 4, an electric field as indicated by solid line $\beta$ is developed and the ion flow, in spite of its being opposite in polarity to the primary electrostatic latent image, does not negate such electrostatic latent image but reaches the recording member 9. Since the primary electrostatic latent image is formed on the insulating member 3 as described, it will be noted that the electrostatic contrast resulting from the quantity of charges may be made extremely high. Also, attenuation of the charges formed can be minimized so that the same primary electrostatic latent image may be repeatedly used to form a secondary electrostatic latent image again and again, thus enabling the retention copying which means production of multiple copy images from a common primary electrostatic latent image. In FIG. 5, it should be noted that the direction of the electric field is shown as being opposite to what it really is, for easier understanding.

Figure 6:
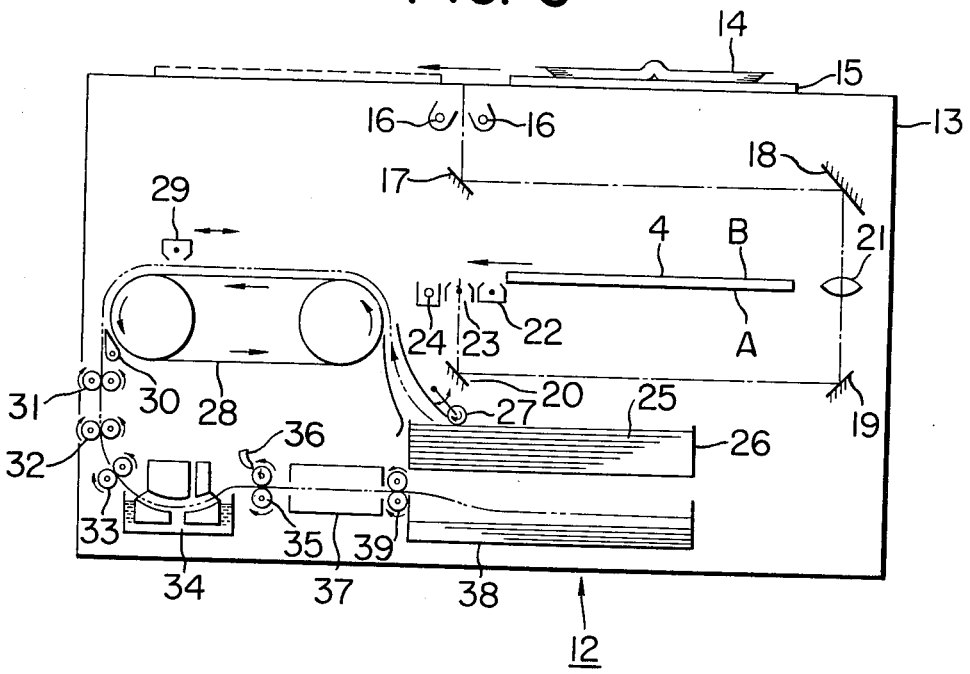
FIG. 6 is a schematic illustration of an embodiment of the copying apparatus to which the present invention is applied.

FIGS. 6 to 10 illustrate the image forming apparatus of the present invention which employs a photosensitive screen undergoing the above-described process of electrostatic latent image formation. FIG. 6 schematically depicts an embodiment of the copying apparatus as the image forming apparatus employing the above-described planar screen 4. The copying apparatus shown in FIG. 6 includes an outer housing on top of which there is an original carriage 15 formed of glass or other transparent plate for carrying an original 14 thereon. The original carriage 15 is of the movable type, and the original 14 may be moved in the direction of arrow to the position as indicated by the dotted line, as it is illuminated by stationary lamps 16. The image of the original, so illuminated, as directed via fixed mirrors 17, 18, 19, 20 and through a lens system 21 with a diaphragm mechanism to reach a corona discharger 23, as indicated by a dot-and-dash-line. The photosensitive screen 4, disposed with its exposed conductive member side facing upwardly, is moved in the direction of the arrow to a secondary electrostatic latent image forming position in synchronism with the movement of the original carriage. During such movement, the screen 4 is subjected to a primary voltage application from a fixedly disposed corona discharger 22. Subsequently, the screen 4 is subjected to a secondary voltage from a stationary corona discharger 23 comprising a shield plate having a portion thereof optically opened, while at the same time the screen is exposed to the image light. The screen 4 is further subjected to overall irradiation by a stationary lamp 24, whereby a primary electrostatic latent image is formed on the screen. In the meantime, a recording member such as a sheet of electrostatic recording paper 25 is fed from a recording paper supply cassette 26 onto an endless conveyor belt 28 provided with a suction or like mechanism, with the aid of a feed roller 27. In the secondary electrostatic latent image forming position on the belt 28, the recording paper 25 has a secondary electrostatic latent image formed thereon by corona discharge from a corona discharger 29, which comprises secondary electrostatic latent image forming means, through the screen 4 with the primary electrostatic latent image already formed thereon. Such secondary electrostatic latent image forming process will hereinafter be described in detail. The recording paper 25 with the secondary electrostatic latent image formed thereon is separated from the conveyor belt 28 by a separator pawl 30 and transported through sets of insulating rollers 31, 32, 33 having their surfaces formed of insulative material such as ceramics, synthetic resin, rubber or the like, into a liquid developing device 34. In the developing device 34, the electrostatic latent image on the recording paper 25 is developed into a visible image, whereafter the recording paper 25 is transported through a set of guide rollers 35 into a drying-fixing device 37, and then received in a tray member 38 through a set of guide rollers 39. It will be noted that the set of rollers 35 is provided with cleaning means such as blade or the like. The copying apparatus 12 operates in the manner described above, and the secondary electrostatic latent image forming process in such apparatus 12 will now be described in detail with reference to FIGS. 7 *a* to 7 *b*. In these figures, corresponding numerals designate corresponding parts in the apparatus of FIG. 6, while numeral 25*a* designates a second sheet of recording paper succeeding the first sheet, and numerals 40, 41, 42 denote a switch, a voltage source for the corona discharger 29, and a timing roller, respectively. A first step (FIG. 7*a*):

I. During the movement of the photosensitive screen 4 at a velocity V in the direction A and before it reaches a point D, a primary electrostatic latent image is formed on the screen 4 through the above-described process. Desirably, the point D is slightly inward of the point where the endless belt 28 enters a horizontal plane, so that the screen 4 and the recording paper 25 will be parallel during the formation of a secondary electrostatic latent image.

II. Simultaneously with (I), the recording paper 25 is conveyed at a velocity V in the direction of arrow. A second step (FIG. 7*b*):

III. The leading end of the recording paper 25 and the leading end A of the image-bearing portion of the screen A becomes aligned at the point D, and they further move toward a point C. When the two members 25 and 4 reach the point C, a corona discharger 29 located on the point C initiates corona discharge with a switch 40 closed to permit a voltage supply from a high voltage source 41 to the discharger 29, while at the same time the discharger also initiates to move at a velocity V′ in the direction opposite to the direction of movement of the screen 4. For the same reason as described with respect to the point D, it is desirable that the point C is slightly short of the point where the endless belt 28 leaves the horizontal plane.

IV. In the position set forth in (III) above, the screen 4 and the recording paper 25 must also maintain a predetermined space therebetween.

During the above-described corona discharge, the ion flow from the corona discharger 29 is modulated by the primary electrostatic latent image on the screen 4, and reaches the recording paper 25 to form a secondary electrostatic latent image thereon.

A third step (FIG. 7*c*):

V. When the corona discharger 29 and the trailing end of the image-bearing portion of the screen 4 reach the point D, the photosensitive screen 4 and the corona discharger 29 reverse their directions of movement. At this moment, the discharger 29 ceases its corona discharge since the switch 40 is opened. The recording paper 25 does not stop but continues to move forward at the velocity V, and if the apparatus is operated in its retention copying mode, a subsequent sheet of recording paper 25*a* will follow the paper 25 with a slight interval maintained therebetween.

VI. The corona discharger 29 and the photosensitive screen 4 restore the position of FIG. 7*b*, whereupon the leading end of the subsequent recording paper 25*a* reaches the point C.

VII. Through repetition of the steps (III) to (VI), it is possible to effect the retention copying at a high speed. Of course, production of a single copy can also be accomplished at a high speed because the short distance of travel of the corona discharger 29 leads to effective utilization of the space within the copying apparatus and because a secondary electrostatic latent image can be formed without stopping the recording paper and screen which are the image forming members.

Figure 8:
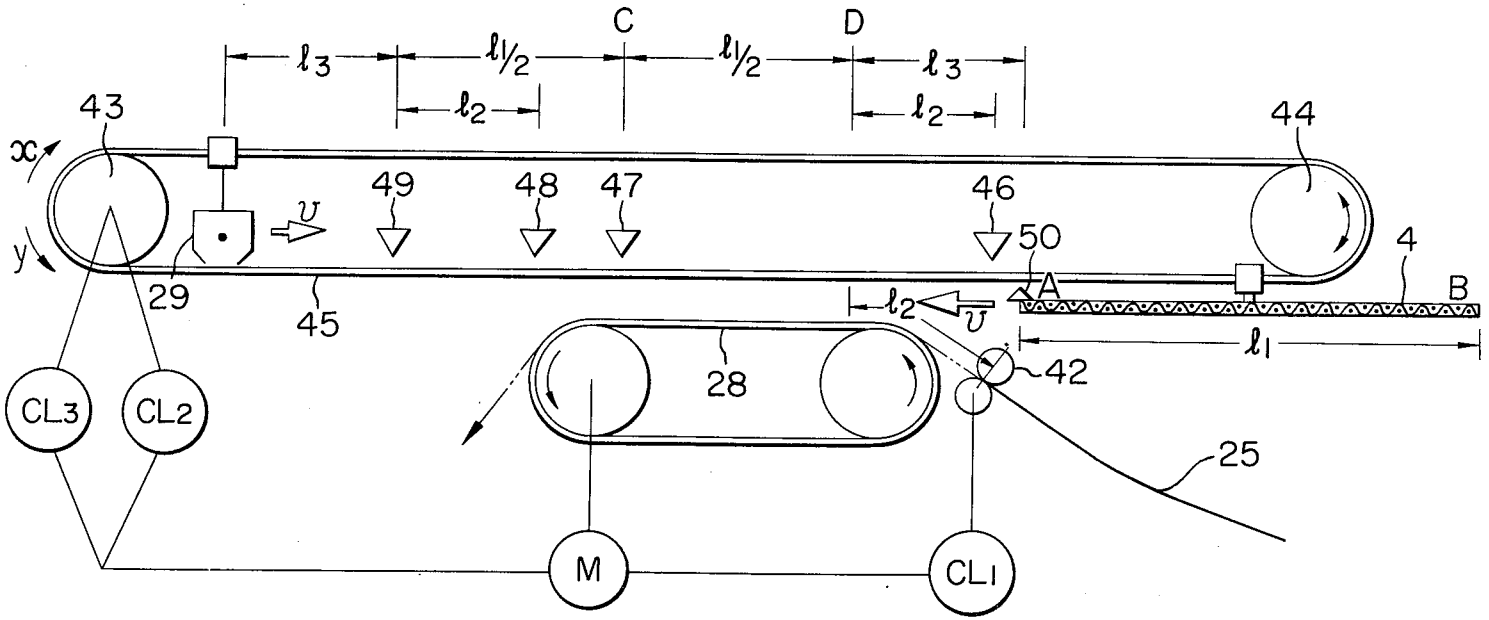
FIG. 8 illustrates an embodiment of the control method for the latent image formation process illustrated in FIG. 7.

An example of the control method for the operating members, such as conveyor belt 28, screen 4, corona discharger 29, etc. in the secondary electrostatic latent image forming process described in connection with FIG. 7, will now be explained with reference to FIG. 8. It should be understood that the following description of the control method carried out by the control mechanism as shown in FIG. 8 is based on the assumption that the velocity V of the screen 4 and the velocity V′ of the corona discharger 29 are equal. As far as the drive systems in the control mechanism of FIG. 8 are concerned, the conveyor belt 28 is connected to a motor M while a timing roller 42 is connected to the motor M through a clutch CL1. The screen 4 and the discharger 29 are secured to a wire 45 tensioned between and around rotatable pulleys 43 and 44, by attachment means. The pulley 43 is a drive pulley connected to the motor M through clutches CL2 and CL3 and designed, for example, such that the pulley 43 is rotated in x-direction when the clutch CL2 is actuated and that the pulley 43 is rotated in y-direction when the clutch CL3 is actuated. Thus, when the clutch CL2 is actuated, the screen 4 is moved in the same direction and at the same velocity with the conveyor belt 28, while the discharger 29 is moved at the same velocity but in the opposite direction with respect to the screen 4. The control of these drive systems is accomplished by signals produced by actuation of switching means arranged in the direction of movement of the screen, which switching means may be first, second, third and fourth switches 46, 47, 48 and 49 in the form of microswitches or the like. Arrangements of the photosensitive screen 4, discharger 29 timing roller 42 and switches 46–49 will hereinafter be described. Since the velocity V equal to the velocity V′, the distance between the points C and D and the distance between, the point C and the fourth switch 49 are both $l_1/2$, where $l_1$ is the effective length of the screen 4, and the distance between the point D and the first switch 46, the distance between the point D and the roller 42 and the distance between the fourth switch 49 and the third switch 48 are all equal, being $l_2$. Further, the distance between the point C and the leading end A of the screen 4 in its initial position and the distance between the point C and the discharger 29 in its initial position are equal, being $l_1/2+ l_3$. The above-described various switches are closed and opened by a cam 50 provided at the leading end A of the screen 4. In this regard, the relations $l_2<l_1/2$ and $l_2<l_3$ are maintained.

Figure 10:
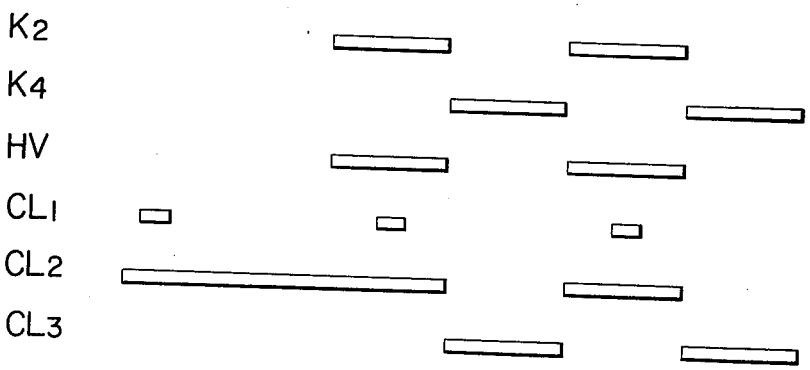
FIG. 10 is a time chart illustrating the timing between the components of the control mechanism shown in FIG. 8.
Figure 7A:
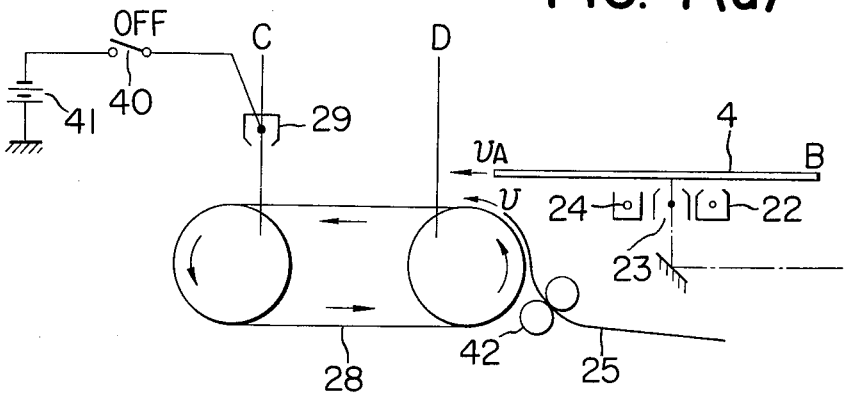
FIGS. 7 *a* to 7 *c* illustrate the process of forming a secondary electrostatic latent image in accordance with the present invention.
Figure 7B:
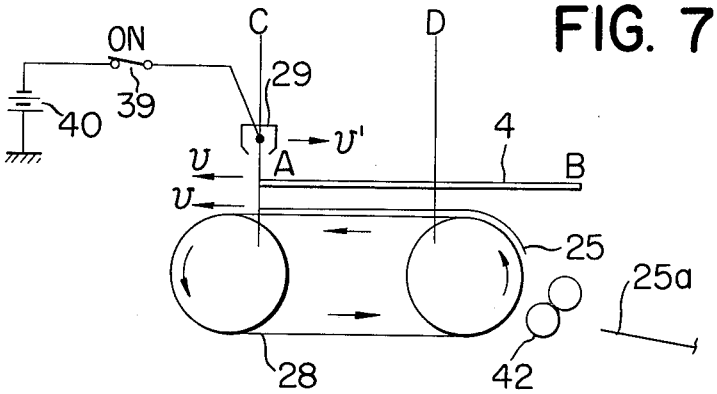
Figure 7C:
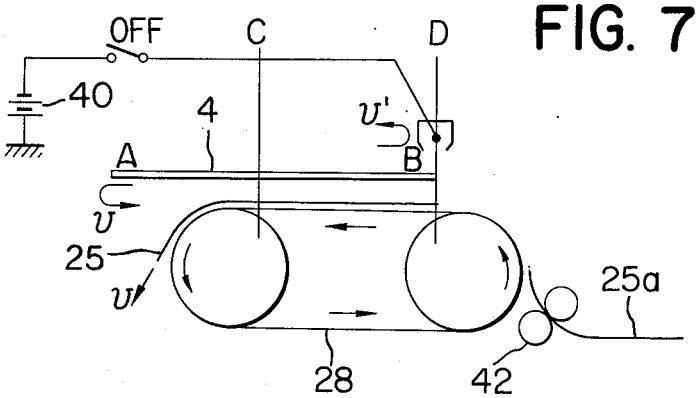
Figure 9:
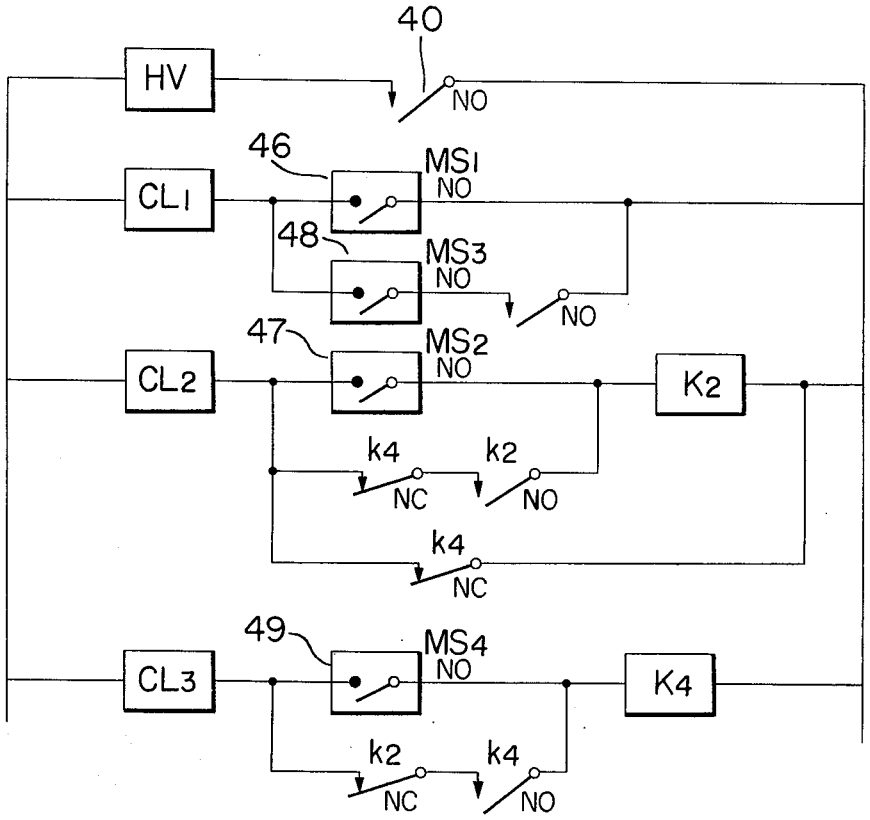
FIG. 9 is a diagram of the electric circuit of the control mechanism shown in FIG. 8.

Operation of the control mechanism shown in FIG. 8 will now be discussed. First, the clutch CL2 is actuated by a signal from a signal source (not shown) to move the screen 4 and discharger 29 at the velocity V in the directions of arrows, respectively. With the movement of the screen 4, the cam 50 opens the first switch 46 to thereby actuate the clutch CL1 to rotate the timing roller 42, whereby the recording paper 25 is fed in synchronism with the screen 4 and onto the conveyor belt 28 moving around at the velocity V. With further movement of the screen 4, the cam 50 opens the second switch 47, located at the point C, to thereby permit a voltage to be applied to the discharger 29 so as to initiate the formation of a secondary electrostatic latent image on the recording paper 25 being transported in synchronism with the screen 4. Further movement of the screen 4 causes the cam 50 to open the third switch 48 to again actuate the clutch CL1 so as to rotate the timing roller 42 for feeding a second sheet of recording paper onto the conveyor belt 28. Continued movement of the screen 4 causes the cam 50 to open the fourth switch 49 to terminate the secondary latent image formation, so that the clutch CL2 is released. Subsequently, the clutch CL3 is actuated to move the screen 4 in the direction opposite to the direction of movement of the discharger 29. When this occurs, the voltage supply to the discharger 29 is already cut off. Further movement of the screen 4 in the opposite direction causes the second switch to be opened to deactivate the clutch CL3 but to actuate the clutch CL2, whereby the screen 4 resumes its forward movement. At this moment, the leading end A of the screen 4 and the leading of the recording paper are aligned and synchronized with each other at the point C. Through repetition of the above-described operation, multiple copies may be continuously produced in a short time. FIG. 9 clearly shows an electric circuit operated for electrostatic latent image to be repetitively formed with the aid of the control mechanism of FIG. 8. In FIG. 9, K designates relays and HV designates the high voltage source portion for the corona discharger 29. FIG. 10 is a time chart illustrating the timing between the various components in the abovedescribed control mechanism.

An embodiment of the copying apparatus described above in connection with FIG. 6 will now be shown. The screen 4 is formed by knitting a stainless wire of 40 $\mu$ diameter into a conductive member of 200 meshes, and spraying against the conductive member CdS particles dispersed in a resin solution so as not to block the openings in the conductive member. The CdS layer thus formed on the conductive member is such that its thickest portion is about 50 $\mu$ while the conductive member is partly exposed at one side surface thereof. An insulating member such as resin or the like is sprayed onto the so provided CdS layer to form a layer of about 20 $\mu$ thickness. Thereafter, the screen is moved at a rate of 160 mm/sec. and subjected to a primary voltage applied from a corona discharger, whereafter a secondary voltage is applied to the screen from the corona discharger 23 supplied with A.C. 8 KV while an imaage is applied to the screen at about 10 lux-sec. for light region, and then the screen is subjected to overall irradiation at 400 lux-sec. by the lamp 24, whereby a primary electrostatic latent image having an electrostatic contrast of 400 volts is formed on the screen 4. During the subsequent or secondary electrostatic latent image formation, the spacing between the screen 4 and the recording paper 25 (for example, TOMOE STAT FOO7M (Trade Name)) is maintained at the order of 3 mm, the conductive member of the screeen 4 is grounded, and the conveyor belt 28 treated for conductivity is set to +3 KV. The corona discharger 29 supplied with −7 KV and moved at a rate of 160 mm/sec. in the direction opposite to the direction of movement of the screen 4, provides an ion flow directed to the recording paper 25, whereby a secondary electrostatic latent image having an electrostatic constrast of 100 V is formed on the recording paper 25.

Figure 11:
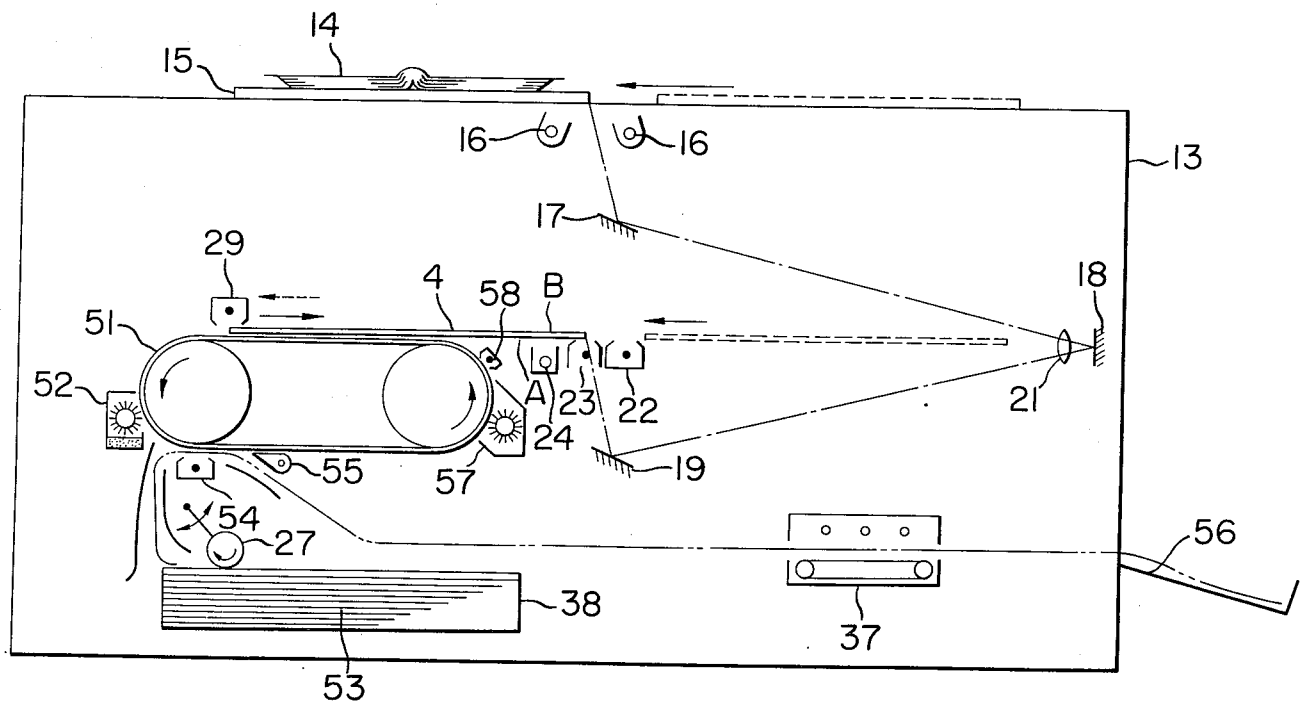
FIGS. 11 and 12 are schematic illustrations of further embodiments of the copying apparatus to which the present invention is applied.
Figure 12:
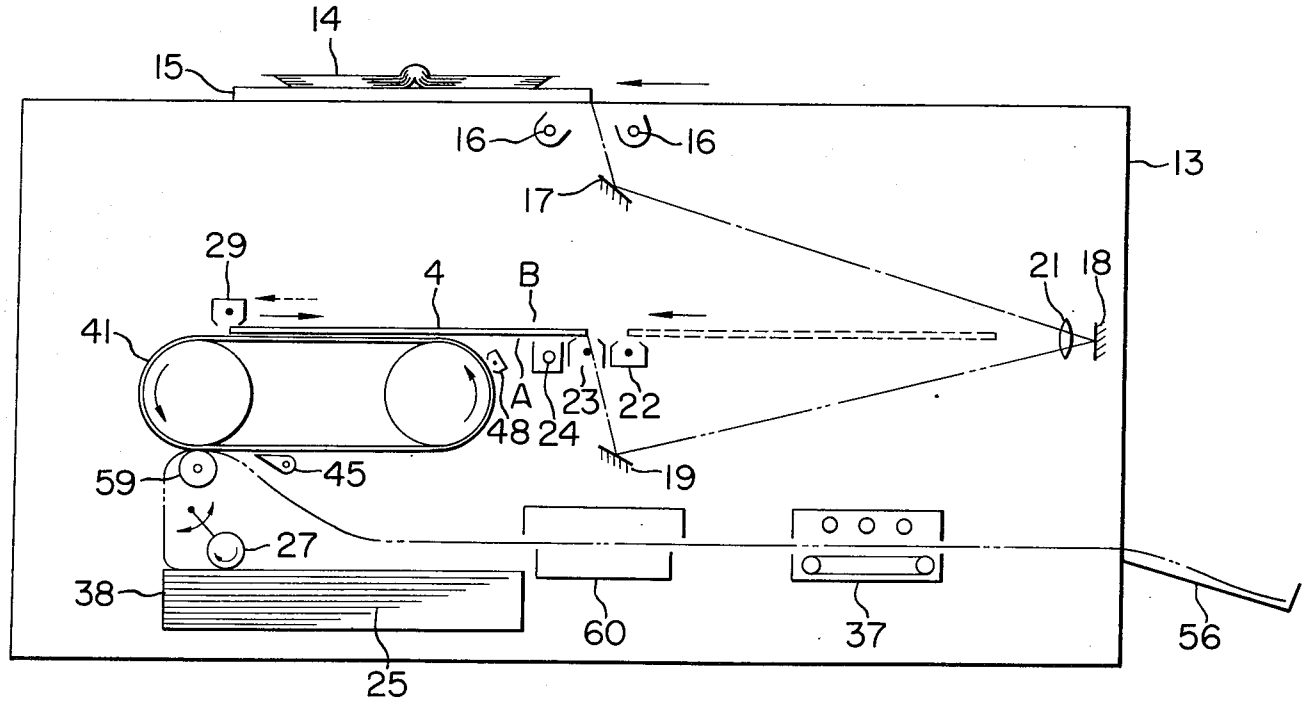

FIGS. 11 and 12 show further embodiments of the copying apparatus which uses the above-described method of the secondary electrostatic latent image formation. Those elements which are the same as those in the apparatus of FIG. 6 are given reference numerals identical with those in FIG. 6.

The copying apparatuses of FIG. 11 and 12 do not employ insulation-treated paper such as electrostatic record paper but employ ordinary paper to form a copy image thereon. In FIG. 11, the image of the original 14 on the carriage 15 is directed, as indicated by a dot-and-dash line, through mirrors and a lens system so as to impinge on that side of the photosensitive screen 4 on which the photoconductive member is thicker. The screen 4 is moved in the direction of arrow from the rest position indicated by dotted lines before it is subjected to application of the image, whereby the screen is subjected to primary voltage application from a corona discharger 22. Subsequently, the screen 4 is subjected to application of the image while being subjected to application of secondary voltage from a corona discharger 23 which is opposite in polarity to the previous voltage. The screen 4 is further subjected to overall irradiation from a lamp 24, whereby a primary electrostatic latent image is formed on the screen. Upon arrival at the position indicated by solid lines the photosensitive screen 4 is subjected to corona discharge from a corona discharger 29 adjacent the surface B of the screen, whereby an ion flow is imparted to an endless chargeable belt 51 having an insulating layer formed on at least one surface thereof, and thus the ion flow is modulated by the primary electrostatic latent image to form a secondary electrostatic latent image therefrom on the chargeable belt 51. When retention copying is desired, the same principle as described in connection with FIG. 7 is applicable but with the electrostatic recording paper 25 eliminated and with the conveyor belt 28 regarded as the chargeable belt 51. In that case, secondary electrostatic latent images may be continuously formed without the chargeable belt 51 being stopped.

The secondary electrostatic latent image formed on the chargeable belt 51 is developed into a visible image by charged toner in a developing device 52. A sheet of transfer paper 53 formed of ordinary paper material is fed from a paper supply cassette 26 to a transfer station by a feed roller 27. In the transfer station, the toner image is transferred from the belt onto the transfer paper 53 with the aid of a transfer corona discharger 54. Thereafter, the transfer paper 53 is separated from the belt 51 by a separator pawl 55 and heated and fixed by a fixing device 37, whereafter the transfer paper is discharged into a tray 56 outside the apparatus. After the image transfer, the chargeable belt 51 is cleaned by a cleaning member 57 and deelectrified by a corona discharger 58 in preparation for a subsequent cycle of secondary electrostatic latent image formation.

The embodiment of the copying apparatus shown in FIG. 12 differs from that of FIG. 11 in that the secondary electrostatic latent image on the chargeable belt 51 is not developed but transferred onto recording paper 25 by means of a transfer roller 59, whereafter the latent image on the recording paper is developed by a known wet or dry type developing device 60 and fixed by a fixing device 37, and then discharged into a tray 56 outside the apparatus.

In FIGS. 6, 11 and 12, the dot- and-dash line within the apparatus indicates the path of the electrostatic recording paper or the transfer paper. The member on which secondary electrostatic latent image is to be formed is not restricted to the above-described kinds of paper but use may also be made of a sheet of synthetic resin, insulation-treated metal, fabrics or like material.

The visualization of the secondary electrostatic latent image may be done not only by the usual developing method using toner or the cloud-mist developing method but also by passing ink or like recording material between the screen and the secondary electrostatic latent image and visualizing the latent image due to the electrostatic dust catching action resulting from the ion flow modulated into the pattern of the image, or by providing on the latent image forming surface in use a material coloring to the ion flow.

When a secondary electrostatic latent image is formed in the manner as described above, the photosensitive screen and the chargeable member are moved in the same direction and at the same velocity and the corona ion discharger is moved in the opposite direction, whereby the stroke of the corona ion discharger need not span the entire length of the photosensitive screen, and the chargeable member need not be stopped moveover, the members on which the secondary electrostatic latent image is to be formed can be continuously conveyed with at slight intervals therebetween. Thus, the present invention eliminates the previously described disadvantages peculiar to the prior art and provides an apparatus which can accomplish rapid image formation.

More specifically, a description will now be made of an apparatus of the type in which, for example, a photosensitive screen and a chargeable member remain stationary while a corona discharger alone is moved during the formation of secondary electrostatic latent image in the retention copying mode. In case of such an apparatus, the chargeable member remains stationary as long as the corona discharger is operating, but according to the present invention, the chargeable member does not remain stationary during the formation of secondary electrostatic latent image. This means that the apparatus of the present invention can effect the formation of secondary electrostatic latent image at a double speed as compared with the apparatus of the described type.

Further, in the present invention, the photosensitive screen is in no way restricted to that shown in FIG. 1 nor limited by the latent image formation method utilizing the illustrated process, but may be any screen which is movable to the secondary electrostatic latent image forming position in a planar manner and which is capable of forming thereon a secondary electrostatic latent image repetitively from a common primary electrostatic latent image. Furthermore, in FIG. 8, the invention has been illustrated with respect to the case where the screen and the corona discharger for the formation of secondary electrostatic latent image are moved at the same velocity, but the invention is not restricted thereto.

We claim:

1. An ion modulation copying system comprising in combination, a photosensitive screen supported in a plane and having a multitude of openings therein;

drive means for reciprocating said screen in said plane between a starting point and a turning point, wherein a secondary electrostatic latent image forming position is disposed between said starting and turning points;

means for forming a primary electrostatic latent image on said screen, said primary electrostatic latent image forming means being disposed between said starting point and said secondary electrostatic latent image forming position;

a chargeable member capable of bearing a secondary electrostatic latent image, said chargeable member being disposed for movement through said secondary electrostatic latent image forming position, in a spaced parallel relation with respect to the plane of said screen;

drive means for moving said chargeable member at the same speed and in the same direction as said screen as the latter moves through said secondary electrostatic latent image forming position toward said turning point;

corona discharging means movably disposed at said secondary electrostatic latent image forming position in spaced apart relationship with a side of said screen opposite to the side thereof facing said chargeable member, wherein said discharge means is for providing an ion source for modulation; and drive means for driving said discharging means through said secondary electrostatic latent image forming position in an opposite direction to that of said screen while the latter moves toward said turning point.

2. An ion modulation copying system according to claim 1, wherein a common drive means is provided to move said screen, said chargeable member and said corona discharging means.

3. An ion modulation copying system according to claim 1, wherein said chargeable member is of cut-sheet form.

4. An ion modulation copying system according to claim 1, wherein said chargeable member includes an endless belt having a chargeable layer on its side which faces said screen at said secondary image forming position, said belt being supported by at least two rotatable rollers to move said chargeable member in a plane at said secondary electrostatic latent image forming position.

5. An ion modulation copying system according to claim 1, wherein said corona discharging means is movable between first and second points at said secondary image forming position, said first point being nearer to said starting point and said second point being nearer to said turning point, the distance between said first point and said second point being less than the length of said screen, and wherein said ion modulation is carried out between said first and second points during movement of said screen and said chargeable member in the direction from said first point to said second point and movement of said corona discharge means in the direction from said second point to said first point.

6. An ion modulation copying system according to claim 5, wherein the distance between said first and second points is substantially equal to one half of the length of said screen, and wherein said screen and said chargeable member are moved at the same speed as, and in the opposite direction to said corona discharge means.

7. An ion modulation copying system according to claim 5, wherein (a) said drive means for driving said discharging means includes means for returning said corona discharge means from said first point to said second point, (b) said drive means for said screen includes means for returning said screen from said turning point to said second point, and (c) said drive means for said chargeable member includes means for moving a portion of said chargeable member at which a subsequent said secondary electrostatic latent image is to be formed to said second point, whereby a plurality of secondary electrostatic latent images can be formed from a single primary electrostatic image on said screen.

8. An ion modulation copying system comprising in combination, a photosensitive screen supported in a plane and having a multitude of openings therein;

drive means for reciprocating said screen in said plane between a starting point and a turning point, wherein a secondary electrostatic latent image forming position is disposed between said starting and turning points;

means for forming a primary electrostatic latent image on said screen, said primary electrostatic latent image forming means being disposed between said starting point and said secondary electrostatic latent image forming position;

a chargeable member capable of bearing a secondary electrostatic latent image, said chargeable member being disposed for movement through said secondary electrostatic latent image forming position, in a spaced parallel relation with respect to the plane of said screen;

drive means for moving said chargeable member at the same speed and in the same direction as said screen as the latter moves through said secondary electrostatic latent image forming position toward said turning point;

corona discharging means movably disposed at said secondary electrostatic latent image forming position in spaced apart relationship with a side of said screen opposite to the side thereof facing said chargeable member, wherein said discharge means is for providing an ion source for modulation; and drive means for driving said discharging means reciprocally through said secondary electrostatic latent image forming position between first and second points;

wherein said first point is nearer to said starting point and said second point is nearer to said turning point;

wherein said ion modulation is carried out between said first and second points during movement of said screen and said chargeable member in the direction from said first point to said second point and movement of said corona discharge means in the direction from said second point to said first point; and wherein (a) said drive means for driving said discharging means includes means for returning said corona discharge means from said first point to said second point, (b) said drive means for said screen includes means for returning said screen from said turning point to said second point, and (c) said drive means for said chargeable member includes means for moving a portion of said chargeable member at which a subsequent said secondary electrostatic latent image is to be formed to said second point, whereby a plurality of secondary electrostatic latent images can be formed from a single primary electrostatic image on said screen.

9. An ion modulation copying system according to claim 8, wherein the distance between said first and second points is substantially equal to one half of the length of said screen, and wherein said screen and said chargeable member are moved at the same speed as, and in the opposite direction to, said corona discharge means.

10. An ion modulation copying system according to claim 8, wherein said chargeable member is of cut-sheet form.

11. An ion modulation copying system according to claim 8, wherein said chargeable member includes an endless belt having a chargeable layer on its side which faces said screen at said secondary image forming position, said belt being supported by at least two rotatable rollers to move said chargeable member in a plane at said secondary electrostatic latent image forming position between said first and second points.

12. An ion modulation copying system according to claim 8, wherein said photosensitive screen comprises a conductive screen exposed at one side and having a photosensitive material on its other side.

13. An ion modulation copying system according to claim 12, wherein the distance between said first and second points is substantially equal to one half of the length of said screen, and wherein said screen and said chargeable member are moved at the same speed as, and in the opposite direction to said corona discharge means.

14. An ion modulation copying system according to claim 12, wherein said chargeable member is of cut-sheet form.

15. An ion modulation copying system according to claim 12, wherein said chargeable member includes an endless belt having a chargeable layer on its side which faces said screen at said secondary image forming position, said belt being supported by at least two rotatable rollers to move said chargeable member in a plane at said secondary electrostatic latent image forming position between said first and second points.

16. An ion modulation copying system according to claim 12, wherein said discharge means is disposed facing said exposed side of said conductive screen, and said primary electrostatic latent image forming means is disposed facing said other side of said screen.

17. An ion modulation copying system according to claim 12, wherein said photosensitive screen further comprises an insulating material overlying said photosensitive material, wherein said insulating material is exposed at the openings of said photosensitive screen and at the side thereof opposite said exposed conductive screen.

18. An ion modulation copying system according to claim 17, wherein said primary electrostatic latent image forming means comprises means for applying a first charge to said photosensitive screen, means for applying second charge thereto, means for applying image light and whole surface exposure to said photosensitive screen, and wherein said discharge means is disposed facing said exposed side of said conductive screen, and said primary electrostatic latent image forming means is disposed facing the side of said screen bearing said insulating material.

* * * * *